US005399113A

United States Patent [19]

DeMasi

[11] Patent Number: 5,399,113

[45] Date of Patent: Mar. 21, 1995

[54] PROTECTOR AGAINST SUBMERGED OBJECTS

[75] Inventor: Douglas D. DeMasi, Hopewell Junction, N.Y.

[73] Assignee: Douglas Builders, Inc., Paughquag, N.Y.

[21] Appl. No.: 217,283

[22] Filed: Mar. 24, 1994

[51] Int. Cl.[6] ..... B63H 5/16

[52] U.S. Cl. ..... 440/71; 440/65

[58] Field of Search ..... 440/52, 53, 56, 64, 440/65, 71, 78

[56] References Cited

U.S. PATENT DOCUMENTS

| | | | |
|---|---|---|---|
| 1,943,288 | 1/1934 | Chandler et al. | 440/56 |
| 3.151,597 | 10/1964 | Larsen | 440/71 |
| 3,939,795 | 2/1976 | Rocka | 440/78 |
| 4,944,702 | 7/1990 | Cain | 440/78 |

*Primary Examiner*—Jesus D. Sotelo
*Attorney, Agent, or Firm*—Joseph B. Taphorn

[57] ABSTRACT

The lower portion of the outdrive of a stern drive motor or of an outboard motor for boats, is further protected from damage on striking submerged objects. Protection at low speed is gained by providing sharp or knife-like edge formed of rubber on the leading of the lower portion to gain the resiliency to cushion from damage at low speeds. Lower portions are typically pivotally mounted with respect to the rest of the motor to enable trim adjustment by a cylinder and piston arrangement. The cylinder and piston arrangement provides some cushion enabling damage-reducing backwards and upwards limited rocking on impact at low moderate speeds. Impact sensing mechanisms conventionally also release the pressure in the cylinder and piston arrangement at low and low-moderate speeds but are generally ineffective at moderate and high speeds to limit damage. The effectiveness is improved by the rubber sharp edge on the lower unit which provides for some travel of the lower portion before it comes into rigid contact with the submerged object, providing time for the impact sensing mechanism to act. Impact damage at high speeds is minimized by the use of piston release mechanisms which allow the lower unit to rock freely of the cylinder and piston arrangement.

18 Claims, 4 Drawing Sheets

PROTECTOR AGAINST SUBMERGED OBJECTS

INTRODUCTION

1. Field of the Invention

This invention relates to devices for protecting the drives of stern and outboard motors of motorboats on striking submerged objects, and more particularly to such devices which are instantly effective on striking a submerged object to prevent damage.

2. Background of the Invention

Submerged objects are an appreciated hazard in motorboating. Efforts to surmount this hazard include the provision of impact sensing mechanisms which endeavor to release the hydraulic positioning mechanisms for power trim adjustment of the drive with respect to the portion rigidly mounted on the transom of the boat and hence to the boat itself. (The trim is adjusted to place the drive in the best attitude for better acceleration, smoother ride, better performance, improved fuel economy, and better top-end speeds.) The power trim adjustment is usually effected through hydraulic piston and cylinder arrangements which in themselves provide some rocking cushion for the drive on impact. Impact sensing mechanisms supplement this cushioning action by acting on the hydraulic positioning mechanism controls to allow the piston to freely move with respect to the cylinder. Examples of such power trim adjustment mechanisms are the Power Trim XD of the MERCRUSISER 1994 Alpha Series for stern drives and the Wide Trim Range of the YAMAHA 1994 Pro Series for outboard drives.

Unfortunately the impact response of such power trim adjustment mechanisms is not sufficiently timely at any but the slowest motorboat speeds.

SUMMARY OF THE INVENTION

Accordingly, it is an object of the invention to prevent damage to motorboat drives upon striking submerged objects.

A further object of the invention is to prevent damage to motorboat drives having power trim adjustment mechanisms employing hydraulic piston and cylinder arrangements, upon striking submerged objects at moderate speeds.

A still further object of the invention is to prevent damage to motorboat drives having power trim adjustment mechanisms employing hydraulic piston and cylinder arrangements which are released by an impact sensing mechanism, upon striking submerged objects at high speeds.

Another object of the invention is to achieve these objects simply and effectively.

The objects of the invention are achieved through two modifications of a drive. According to one modification, the knife-like vertical front edge of the lower portion of drive mounting behind it the propeller, is made of a yieldable material. In a retrofit application of the invention, a rubber boot having a knife-like leading edge is mounted over the drive lower portion front edge. On striking a submerged object, not only does the rubber of the boot itself yield to cushion the impact, but the time spent in further travel of the drive lower portion after initial contact gives the impact sensing mechanism more time to release the hydraulic positioning mechanism so that the drive can timely swing backwards and upwards over the struck submerged obstacle if the motor boat was proceeding at moderate speeds.

In the other modification, the connection of the cylinder and piston arrangement to one of the drive lower portion and the transom fixed portion, is made releasable. Generally, the free end of the piston is pivotally connected to the drive. By releasably connecting this free end of the piston to the drive, the drive can swing backwards and upwards over the struck submerged obstacle even if the impact sensing mechanism has not had sufficient time to release the hydraulic positioning mechanism. Thus damage is minimized even in high speed accidents.

An advantage of the invention is that lives will be saved by motorboat drives being left functional. Boats will be able to make it back to ports on their own.

Another advantage of the invention is that boat owners will save thousands of dollars. The yielding action of the drive will avoid crushing of its components to where operation of the drive is precluded and maintenance ordained.

A further advantage of the invention is that down time is reduced. Repair itself is time consuming; "standing in line" for repair can even be worse.

Use of the protection devices will give the boat owner and his family and friends more peace of mind, and make boating more pleasurable for all persons concerned.

A feature of the invention is that all of these advantages can be had inexpensively.

BRIEF DESCRIPTION OF DRAWINGS OF PREFERRED INVENTION EMBODIMENTS

These and other objects, features and advantages of the invention will become apparent from a reading of the following description, when considered with the appended drawings wherein.

DETAILED DESCRIPTIONS OF PREFERRED EMBODIMENTS OF THE INVENTION

Figure 1:
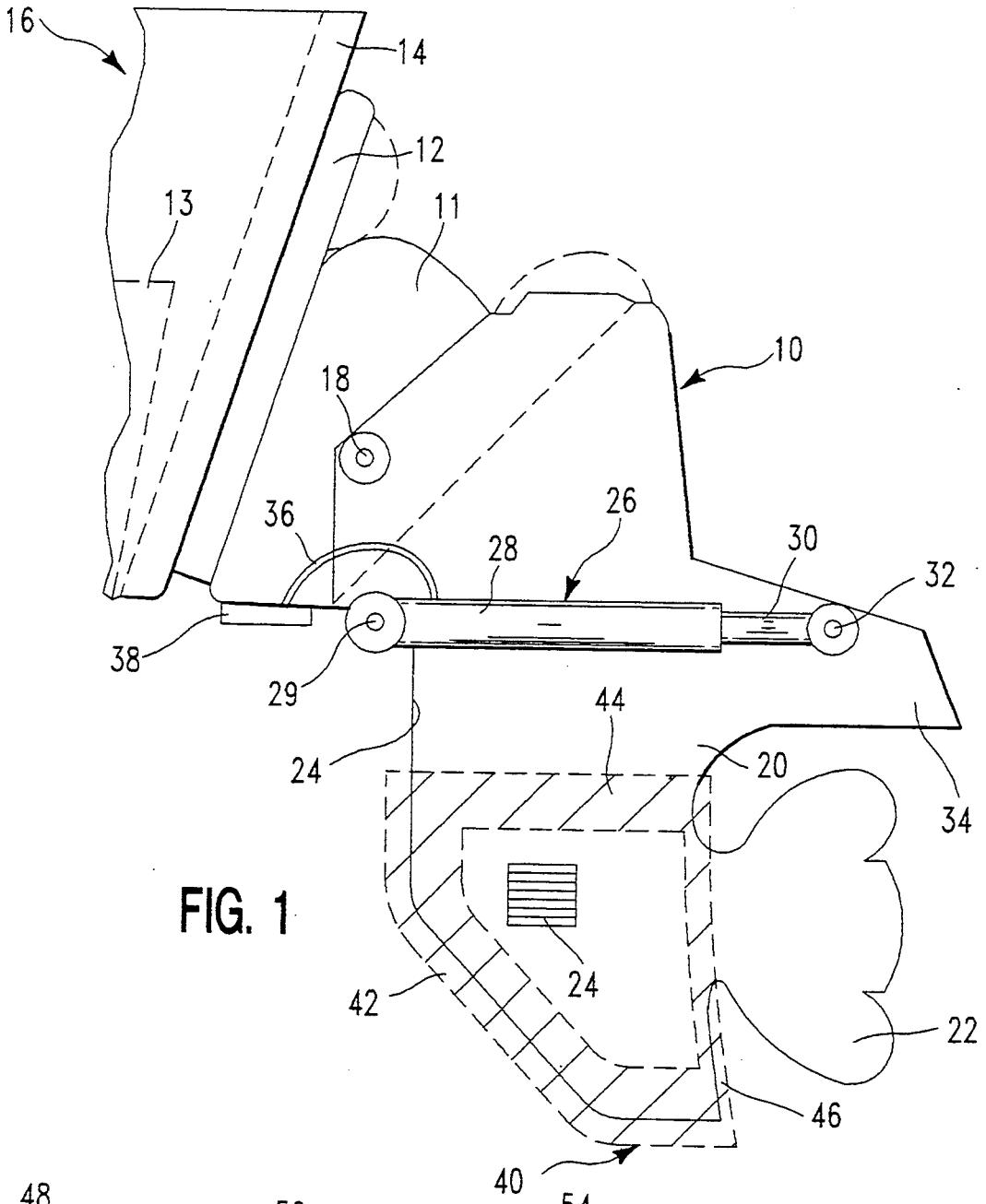
FIG. 1 is a side view of the outdrive for an inboard motor showing a rubber boot of a horizontal and vertical strap design in place over the lower end or skag of the outdrive.

Referring now more particularly to the drawings, there is shown in FIG. 1 the outdrive, generally indicated by the numeral 10, of a stern drive having an inboard motor 13. The outdrive 10, includes an upper unit 11 having at its upper left side and integral with it, a ring 12 by which the upper unit 11 is rigidly secured to the transom 14 of a boat generally indicated by the numeral 16. The upper unit 11 provides midway up its rear side, a pivot 18 on which the lower unit 20 of the outdrive 10 is mounted at its upper forward side for swinging movement for trim adjustment.

The lower unit 20 mounts a propeller 22 on a suitable horizontal shaft that is driven by a drive shaft extending upward to connect with a horizontal shaft driven by the inboard motor 13. So the lower unit 20 is an envelope which encloses the shafts, and has a narrow or knife-like leading edge to cut through water with a minimum of resistance or drag. The lower unit 20 may include an opening grill 24 for the admission of water for cooling purposes.

The lower unit 20 is positioned with respect to the upper unit 11 (trimmed with respect to the boat 16) through a cylinder and piston arrangement generally indicated by the numeral 26. To this end the cylinder and piston arrangement 26 has a cylinder 28 whose free or left hand end is swingably mounted on a pivot 29 on the lower rearward side of the upper unit 11. A piston 30 of the arrangement 26 has its free end swingably mounted on a pivot 32 on the rear or trailing portion 34 of the lower unit 20. The pivots 18, 29 and 32 are so arranged with respect to each other that when the cylinder and piston arrangement expands or contracts, the lower unit 20 rotates counterclockwise or clockwise about the pivot 18 on the upper unit 11.

The cylinder and piston arrangement 26 expands and contracts under hydraulic pressure applied to it via hose 36. Application of fluid pressure is in part controlled by an impact sensing mechanism 38. When the lower unit 20 strikes a submerged object, the sudden acceleration change is sensed by the impact sensing mechanism. The impact sensing mechanism in turn releases the fluid pressure in the cylinder and piston arrangement 26 and allows free movement of the piston 30 with respect to the cylinder 28 and hence of the lower unit 20 with respect to the upper unit 11 and boat 16. Hence the lower unit can rock over a struck submerged object.

FIG. 1 shows a rubber or other resilient material open boot generally indicated by the numeral 40 strapped on the lower end of the lower unit 20. The open boot includes a sharp or knife-like leading edge portion 42, and stretchable horizontal strap 44 and split (for the propeller shaft mount) vertical strap 46 for holding the sharp or knife-like leading edge portion 42 in place. When the lower end of the lower unit 20 of the outdrive 10 strikes a submerged object, the sharp or knife-like leading edge portion 42 of the rubber boot 40 yields, fully protecting the outdrive 10 at low speeds. At moderate speeds, the time spent in forward travel while compressing the rubber, allows the impact sensing mechanism to release timely at moderate speeds the pressure in the cylinder and piston arrangement and the lower unit to rock upwards out of the way of the submerged object with no or a minimum of damage.

Figure 2:
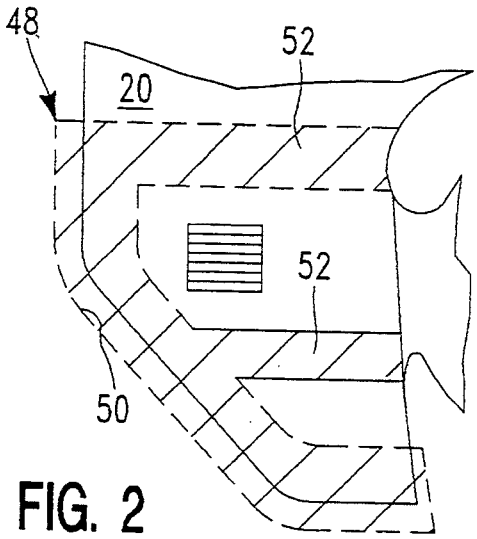
FIG. 2 is a side view showing the lower end or skag of the outdrive with a boot of a different strap design in place.

FIG. 2 shows another rubber-strapped open boot, generally indicated by the numeral 48. It too has a sharp or knife-like leading edge 50. However, stretchable horizontal straps 52, rather than vertical straps, are employed to hold the sharp or knife-like leading edge 50 in place.

Figure 3:
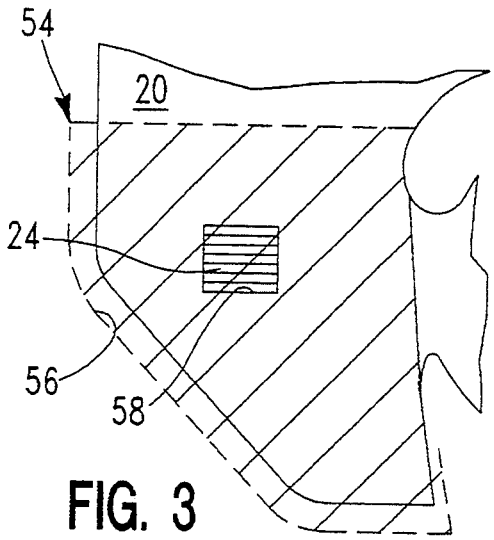
FIG. 3 is a side view showing the lower end or skag of the outdrive with a full cover boot in place.
Figure 4:
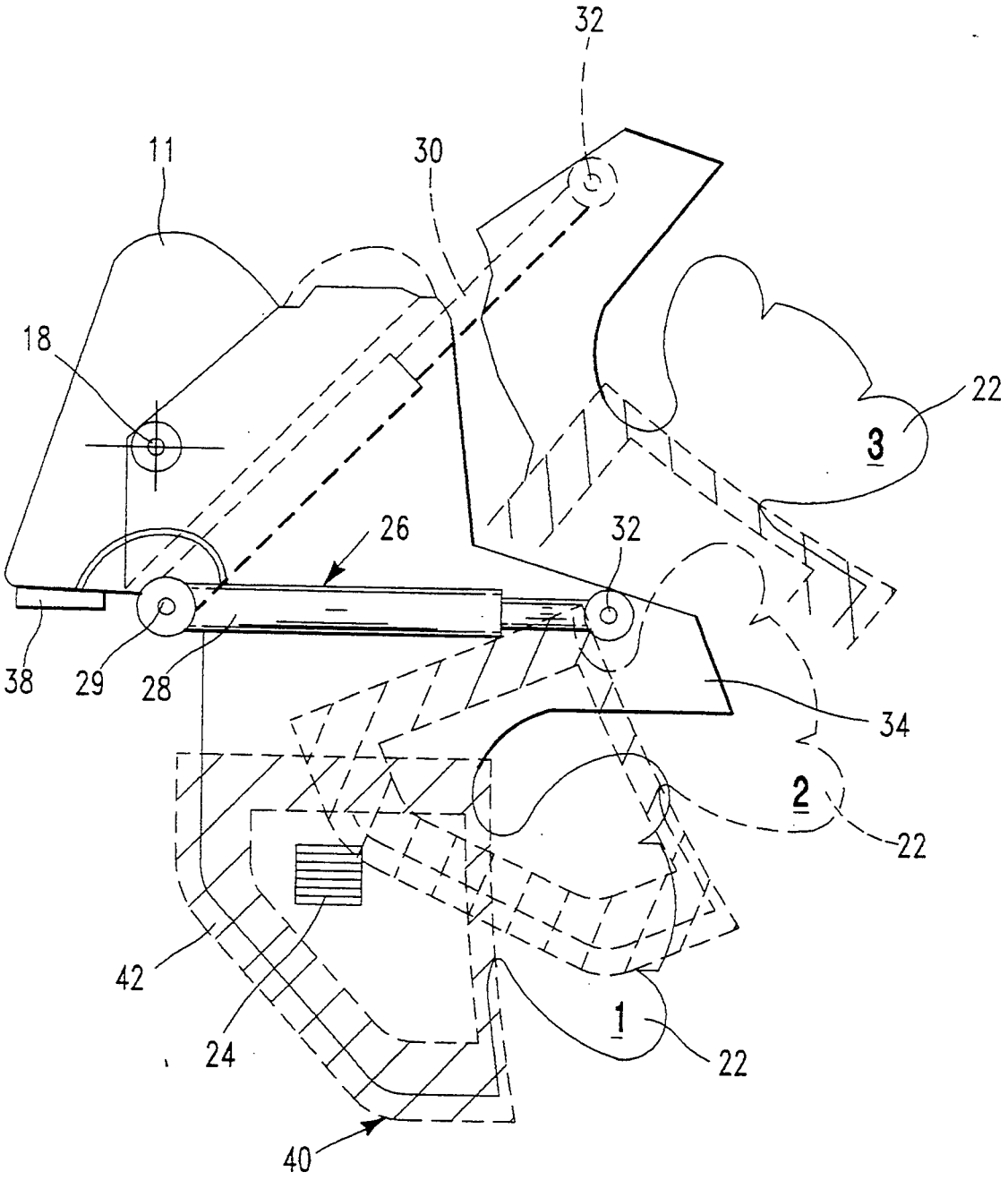
FIG. 4 is a side view of the outdrive showing the positions assumed by the outdrive as it swings backwards and upwards upon striking a submerged object and the impact sensing mechanism has released the cylinder and piston arrangement.

FIG. 3 shows another rubber open boot, generally indicated by the numeral 54. It too has a sharp or knife-like leading edge 56. However, rather than having horizontal or vertical straps to hold its sharp or knife-like leading edge in place, stretchable full sides and rear are employed to hold the sharp or knife-like leading edge 56 in place. Of course, a cut-out exists in the rear to accommodate the mount for propeller 22. Also a cut-out 58 exists to accommodate the water flow through the lower unit opening grill 24.

FIGS. 5 to 15 show instrumentalities that when incorporated assist in avoiding damage at high motor boat speeds. At low speeds, cushioning of the sharp or knife-like leading edges of the rubber boots 40 or 48 or 54 may be sufficient of themselves to prevent damage to the outdrive 10. At moderate speeds the time gained from travel during rubber compression may be sufficient for the impact mechanism to sense the strike and release the pressure in the cylinder and piston arrangement permitting the lower unit 20 timely to rock over the submerged object and avoid damage.

The instrumentalities of FIGS. 5 to 15 feature quick-release mechanisms enabling the lower unit 20 to rock over the struck submerged object with a minimum of damage. Either the piston 30 is separated into two parts or the piston is readily separated from the pivot 32. It is the piston end of the arrangement 26 that is separated from the lower unit 20 in order to minimize the mass which will be rocked by the submerged object. Minimizing the mass is also the reason that the lighter piston 30 rather than the heavier cylinder 28 is directly connected to the movable mass.

Figure 5:
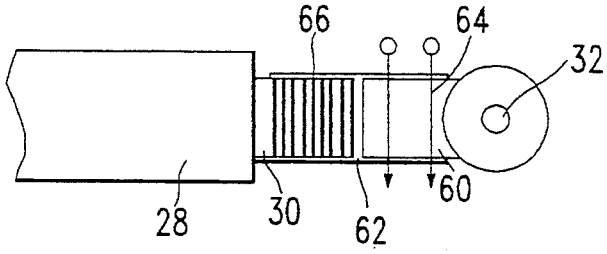
FIG. 5 is a side view of a piston having a cotter pin drive release mechanism in its free end.
Figure 6:
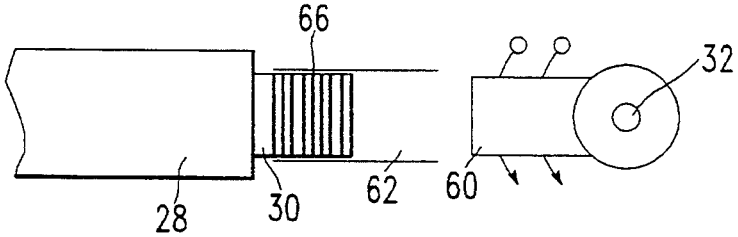
FIG. 6 is a side view of the FIG. 5 piston after drive impact.
Figure 7:
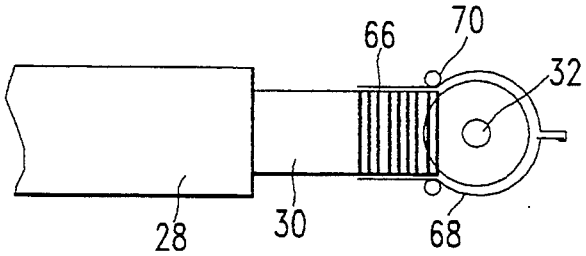
FIG. 7 is a side view of a piston having a spring release mechanism about the pivot.

The instrumentality of FIG. 5 shows the piston 30 as having a separable part 60 swingably mounted on the pivot 32. The two are normally joined through a sleeve 62 internally threaded at one end to be screwed on the adjacent, threaded end of the part 30, and apertured at its other end to receive cotter pins 64 insertable through corresponding holes in the separable part 60. Upon striking at high speed a submerged object, the force on the lower unit 20 causes the cotter pins 64 to shear, releasing the separable part 60 from the still firmly held piston 30 and allowing the lower unit to rock about the pivot 18 on the upper unit 11 to out of serious harm's way. The threads on the piston 30 and sleeve 62 allow a fine tuning adjustment of the trim in the home position of the lower unit 20. FIG. 6 shows the status of the FIG. 5 parts after impact has occurred.

Figure 8:
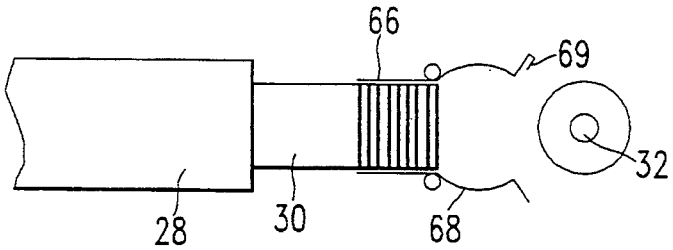
FIG. 8 is a side view of the FIG. 7 piston after drive impact.

The instrumentality of FIG. 7 shows again a sleeve 66 internally threaded at one end for screwing onto the piston 30 projecting from the cylinder 28. However this time the other end of the sleeve 66 is spring hinged to the ends of two semicylindrical flaps 68 together forming a cylinder to embrace the pivot 32 with the other end of one having a lip 69 to overlap the other. The cylinder is held closed on the pivot 32 with different settings for a pressure release lock. FIG. 8 shows the parts apart.

Figure 9:
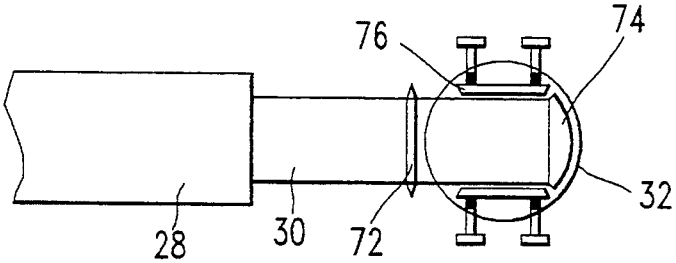
FIG. 9 is a side view of a piston whose free end is received within the pivot and held there by adjusting plates.
Figure 10:
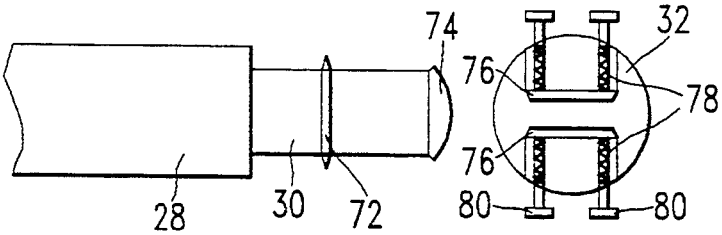
FIG. 10 is a side view of the FIG. 9 piston after drive impact.

The instrumentality of FIG. 9 shows the piston 30 extending through an opening in the rotatable enlarged pivot 32. The piston is formed with two rings 72 and 74 which abut the outside edges of two pressure plates 76 within the enlarged pivot 32. Compression springs 78 adjusted by screws 80 behind them, resist displacement by the ring 72 or 74 to hold releasably the piston 30 in place on the pivot 32. FIG. 10 shows the parts after release.

Figure 11:
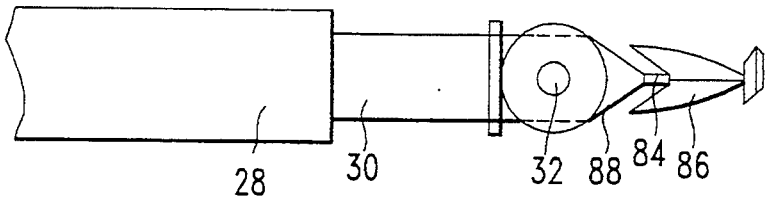
FIG. 11 is a side view of a piston whose free end is received within the pivot and held there by a claw spring.
Figure 12:
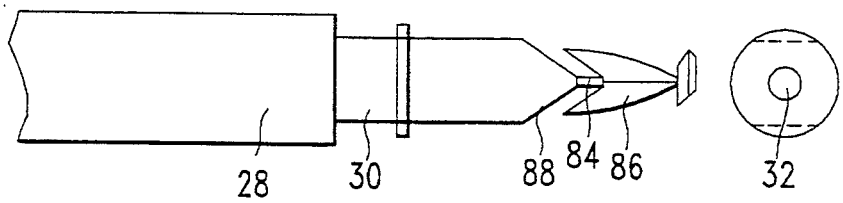
FIG. 12 is a side view of the FIG. 12 piston after drive impact.

The instrumentality of FIG. 11 shows the piston 30 of FIG. 9 with a claw spring mechanism 82 instead of the ring 74 and the pressure plates 76 to hold the free end of the piston in the opening in the rotatable enlarged pivot 32. The claw spring includes a central rod 84 which when the pull from the piston become sufficiently great, pulls the free ends of claws 86 together on the conical surface 88 on the end of the piston to allow the piston to disengage from the pivot. FIG. 12 shows the parts after release.

Figure 13:
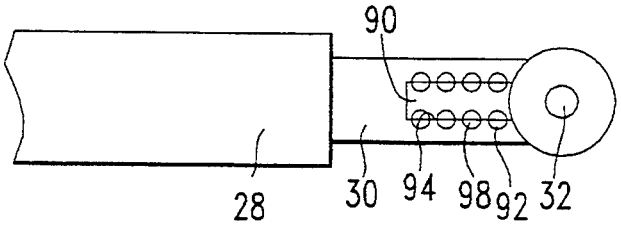
FIG. 13 is a side view of a piston having a spring ball bearing release mechanism in its free end.
Figure 14:
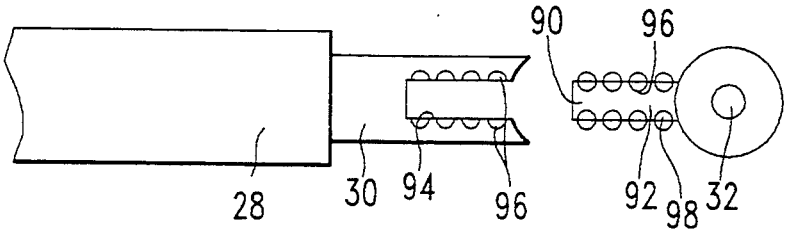
FIG. 14 is a side view of the FIG. 13 piston after drive impact.

FIG. 13 shows, like FIGS. 5 and 6, a piston 30 having a reduced-dimension separable cylindrical part 90 swingable on the pivot 32. The free end of the piston main part is slotted at 94 and provided with internal ball beating seats 96. The separable part 92 is formed on opposite sides with ball bearing seats 96 which receive ball bearings 98. The part 92 is inserted into the piston 30 with the ball bearings 98 in the plane of the slot 94, and then twisted to place the balls in the ball bearing seats 96. The bifurcated end of the piston 30 provides the leaf spring pressure normally holding the parts together. FIG. 14 shows the parts separated. Different pressure settings may be effected in various ways, including twisting to less deep seats 96.

Figure 15:
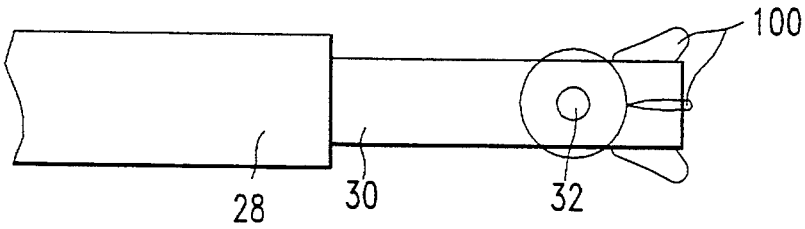
FIG. 15 is a side view of a piston whose free end is received within the pivot and held there by inside springs whose pressure is screw adjustable.
Figure 16:
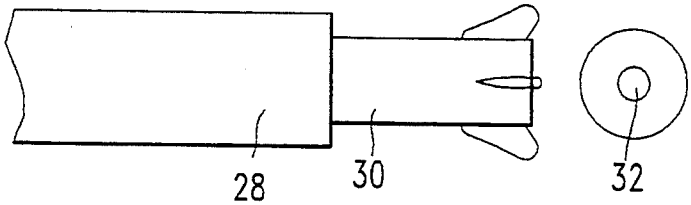
FIG. 16 is a side view of the FIG. 15 piston after drive impact.

The instrumentality of FIGS. 15 and 16 is like that of FIGS. 9 and 10 and FIGS. 11 and 12 in that the free end of the piston 30 extends through the rotatable pivot 30. However the free end of the piston is provided with outwardly flaring leaf springs 100 which must be compressed for the piston to pull out of the pivot 32 on impact.

While there have been shown and described preferred embodiments of the invention applicable to both stern and outboard drives, it will be apparent to those skilled in the art that other and different applications may be made of the principles of the invention. It is therefore intended to be limited only by the scope or spirit of the appended claims.

What is claimed is:

1. In a drive for a motorboat, a lower portion for extending beneath the surface of the water upon which a motorboat may be riding, a propeller mounted on said portion rearwardly of it, and a sharp edge of resilient material mounted on said portion forwardly of it, said sharp edge cushioning the lower portion from damage on impact at low speeds with submerged objects, wherein the sharp edge is a retrofit and held on to the lower portion by horizontal and vertical straps.

2. In a drive for a motorboat, a lower-portion for extending beneath the surface of the water upon which a motorboat may be riding, a propeller mounted on said portion rearwardly of it, and a sharp edge of resilient material mounted on said portion forwardly of it, said sharp edge cushioning the lower portion from damage on impact at low speeds with submerged objects, wherein the sharp edge is a retrofit and held on to the lower portion by horizontal straps.

3. In a drive for a motorboat, a lower portion for extending beneath the surface of the water upon which a motorboat may be riding, a propeller mounted on said portion rearwardly of it, and a sharp edge of resilient material mounted on said portion forwardly of it, said sharp edge cushioning the lower portion from damage on impact at low speeds with submerged objects, wherein the sharp edge is a retrofit and held on to the lower portion by solid sides suitably apertured for cooling-water flow.

4. In a drive for a motorboat, a lower portion for extending beneath the surface of the water upon which a motorboat may be riding, a propeller mounted on said portion rearwardly of it, and a sharp edge of resilient material mounted on said portion forwardly of it, said sharp edge cushioning the lower portion from damage on impact at low speeds with submerged objects, wherein the drive includes an upper portion for securing the drive to a boat transom, a pivot on the upper portion for swingably supporting the lower portion, a second pivot on the upper portion remote from the first pivot, a cylinder and piston arrangement swingably supported at one end on the upper portion second pivot, and a pivot on said lower portion remote from the upper portion first pivot for swingably supporting the other end of the cylinder and piston arrangement, the cylinder and piston arrangement being swingably supported at its other end on the lower portion remote pivot, said cylinder and piston arrangement further cushioning the lower portion from damage on impact at low moderate speeds by allowing some rocking of the lower unit about its pivot on the upper unit after compression of the sharp edge of resilient material.

5. A drive according to claim 4, and an impact sensing mechanism for releasing the fluid pressure in the cylinder and piston arrangement on impact at high moderate speeds of the lower unit with a submerged object to allow free rocking movement of the lower unit on its upper unit pivot.

6. A drive according to claim 5, wherein the free end of the piston of the cylinder and piston arrangement is swingably mounted on the lower portion remote pivot, and a quick release mechanism associated with the free end of the piston for operatively disconnecting the free end of the piston from the lower unit pivot on impact at high speeds of the lower unit with a submerged object in order to minimize damage.

7. A drive according to claim 4, wherein the free end of the piston of the cylinder and piston arrangement is swingably mounted on the lower portion remote pivot, and a quick release mechanism associated with the free end of the piston for operatively disconnecting the free end of the piston from the lower unit pivot on impact at high speeds of the lower unit with a submerged object in order to minimize damage.

8. In a drive for a motorboat, a lower portion for extending beneath the surface of the water upon which a motorboat may be riding, a propeller mounted on said portion rearwardly of it, the drive includes an upper portion for securing the drive to a boat transom, a pivot on the upper portion for swingably supporting the lower portion, a second pivot on the upper portion remote from the first pivot, a cylinder and piston arrangement swingably supported at one end on the upper portion second pivot, and a pivot on said lower portion remote from the upper portion first pivot for swingably supporting the other end of the cylinder and piston arrangement, the cylinder and piston arrangement being swingably supported at its other end on the lower portion remote pivot, said cylinder and piston arrangement cushioning the lower portion from severe damage on impact at low moderate speeds by allowing some rocking of the lower unit about its pivot on the upper unit, the free end of the piston of the cylinder and piston arrangement is swingably mounted on the lower portion remote pivot, and a quick release mechanism associated with the free end of the piston for operatively disconnecting the free end of the piston from the lower unit pivot on impact at high speeds of the lower unit with a submerged object in order to minimize damage.

9. A drive according to claim 8, wherein the quick release mechanism involves a separable piston.

10. A drive according to claim 9, wherein the parts of the separable piston are normally held together by a sleeve that is internally threaded at one end and apertured at its other end for receiving cotter pins also received in the separable piston part and sheared on impact.

11. A drive according to claim 9, wherein the free end of the piston extends through the lower portion remote pivot and bears outwardly diverging leaf springs to hold the free end of the piston in the lower portion remote pivot.

12. A drive according to claim 9, wherein the end of the piston is slotted and formed with internal ball bearing seats, and the separable part is of reduced dimension so as to be received within the slot and formed with diagonally opposite ball bearing seats carrying ball beatings which are seated within the piston seats by sidewise insertion in the slot and twisting of the separable part, the slotted end of the piston functioning as leaf springs to hold the parts together until impact.

13. A drive according to claim 8, wherein the quick release mechanism involves the piston separating from the pivot.

14. A drive according to claim 13, wherein a clamp having an internally threaded sleeve engages the piston and having sidewise semicylinders adhered thereto on spring tensioned hinges for engaging about the lower portion remote pivot.

15. A drive according to claim 13, wherein the free end of the piston extends through the pivot.

16. A drive according to claim 15, wherein the free end of the piston is formed with spaced annular rings, and tensioned plates inside the pivot seat between the rings to hold the piston in place.

17. A drive according to claim 15, wherein the end of the piston conically shaped and carries a claw spring on a rod operative to pull the claws together on impact.

18. In a drive for a motorboat, a lower portion for extending beneath the surface of the water upon which a motorboat may be riding, a propeller mounted on said portion rearwardly of it, the drive includes an upper portion for securing the drive to a boat transom, a pivot on the upper portion for swingably supporting the lower portion, a second pivot on the upper portion remote from the first pivot, a cylinder and piston arrangement swingably supported at one end on the Upper portion second pivot, and a pivot on said lower portion remote from the upper portion first pivot for swingably supporting the other end of the cylinder and piston arrangement;

the cylinder and piston arrangement being swingably supported at its other end on the lower portion remote pivot, said cylinder and piston arrangement cushioning the lower portion from severe damage on impact at low moderate speeds by allowing some rocking of the lower unit about its pivot on the Upper unit, the free end of the piston of the cylinder and piston arrangement is swingably mounted on the portion remote pivot, an impact sensing mechanism for releasing the fluid pressure in the cylinder and piston arrangement on impact at high moderate speeds of the lower unit with a submerged object to allow free rocking movement of the lower unit on its upper unit pivot and a quick release mechanism associated with the free end of the piston for operatively disconnecting the free end of the piston from the lower unit pivot on impact at high speeds of the lower unit with a submerged object in order to minimize severe damage.

* * * * *